United States Patent [19]

Trampe

[11] Patent Number: 4,614,059

[45] Date of Patent: Sep. 30, 1986

[54] AUTOMATIC WINDOW

[76] Inventor: Douglas R. Trampe, 1904 Bel Air, Norfolk, Nebr. 68701

[21] Appl. No.: 750,936

[22] Filed: Jul. 1, 1985

[51] Int. Cl.[4] ..... E05F 17/00

[52] U.S. Cl. ..... 49/118; 49/122; 49/357; 49/383; 49/334; 49/336; 49/395

[58] Field of Search ..... 49/118, 122, 357, 383, 49/336, 334, 394, 395; 109/19, 11, 10

[56] References Cited

U.S. PATENT DOCUMENTS

| | | | |
|---|---|---|---|
| 952,064 | 3/1910 | Bolewicz | 49/336 |
| 1,559,896 | 11/1925 | Larsen | 49/336 |
| 2,676,796 | 4/1954 | Meyerholz | 49/336 |
| 3,087,720 | 4/1963 | Catlett | 49/336 |
| 3,237,932 | 3/1966 | Catlett | 49/334 |
| 3,247,615 | 4/1966 | Kalog | 49/334 |
| 3,470,653 | 10/1969 | Kalog | 49/32 |
| 3,827,183 | 8/1974 | Zimmerman et al. | 49/383 |
| 4,087,939 | 5/1978 | Elguindy et al. | 49/118 |
| 4,149,474 | 4/1979 | Ruane | 109/19 |
| 4,157,071 | 6/1979 | King | 109/19 |
| 4,158,999 | 6/1979 | Sukolics | 109/19 |
| 4,220,051 | 9/1980 | Catlett | 49/336 |

*Primary Examiner*—Philip C. Kannan

*Attorney, Agent, or Firm*—Zarley, McKee, Thomte, Voorhees & Sease

[57] ABSTRACT

An automatic window includes an inverted U-shaped frame having a pair of window units pivotally supported within the frame for movement between open and closed positions. The combined width of the window units is substantially less than the spacing between the frame side walls to provide clearance spaces which are filled by resilient deformable finger guards on the side edges of the window units preventing injury. A power source acts through a rack and pinion gear arrangement to open and close the window units in unison. A backup locking device secures the window units in the closed positions thereof and deactivates the power source when the lock system is engaged.

11 Claims, 9 Drawing Figures

AUTOMATIC WINDOW

BACKGROUND OF THE INVENTION

The present invention is directed generally to an automatic window particularly adapted for retail sales of products through a drive-up window. The automatic opening and closing of the individual window unit is controlled by a switch which does not require use of the operator's hands.

In the fast food industry in particular, drive-up windows have become popular whereby a customer can conveniently purchase a meal without leaving his car. Conventional drive-up windows typically have pivoting window units which must be manually opened and closed. The manual operation can tie up one hand of the attendant and generally interfere with the efficient transfer of payment and goods through the window. Furthermore, the continuous handling of the window units can create an unsanitary environment or require frequent cleaning of the window units. Heating and cooling costs are escalated by such manually operated windows which are often times left open by a busy attendant.

Power operated doors, in particular, are known and in common use in grocery stores and the like. The same technology does not lend itself directly to the design of drive-up windows because of several inherent dangers. First, there is the danger of catching the fingers of either the attendant or the customer between the automatically closeable window units. Furthermore, it is necessary that the automatic window unit be securely locked when not in use to guard against breakins to the retail establishment. Thirdly, because a drive-up window is exposed to rain, beverage spills and other moisture conditions, it must provide for fail safe protection against electrical shocks to those using the automatic window.

Accordingly, a primary object of the invention is to provide an improved automatic window.

Another object is to provide an automatic window which may be opened and closed by a hands-free switch mechanism.

Another object is to provide an automatic window which automatically closes when unattended, thereby to enhance security as well as heating and cooling efficiency.

Another object is to provide an automatic window adapted for hands-free operation and the resulting cleanliness associated therewith.

Another object is to provide an automatic window wherein users are protected against electrical shock even in the event of moisture entering the circuitry thereof.

Another object is to provide an automatic window having a concealed backup locking system for maximum security.

Another object is to provide an automatic window unit which is simple and rugged in construction, inexpensive to manufacture and efficient in operation.

SUMMARY OF THE INVENTION

The automatic window of the invention includes a generally inverted u-shaped frame having a pair of window units pivotally supported within the frame for movement between closed positions lying in a transverse plain through the frame and open positions generally perpendictular thereto. The combined widths of the window units is substantially less than the spacing between the frame side walls so that clearance spaces are provided between the window units and between each window unit and the adjacent frame side wall. These clearance spaces are filled by resilient deformable finger guards secured to side edges of the window units thereby to prevent injury to any users of the automatic window.

A power source such as an electric motor drives a mechanical drive mechanism for opening and closing the window units. Actuation of the power means is controlled by a handsfree switch. The mechanical drive mechanism is preferably a rack and pinion gear arrangement whereby pinion gears on the window unit support shafts are rotated in opposite directions in response to translational movement of the rack gear.

A backup locking device is provided on the automatic window unit for securely locking the window units in the closed positions thereof and deactivating the power source when the lock system is engaged.

BRIEF DESCRIPTION OF THE DRAWINGS

FIG. 9 is a partial top view showing the window units in the closed positions and with the deformable finger guards preventing injury to a hand inserted there between.

DESCRIPTION OF THE PREFERRED EMBODIMENT

Figure 2:
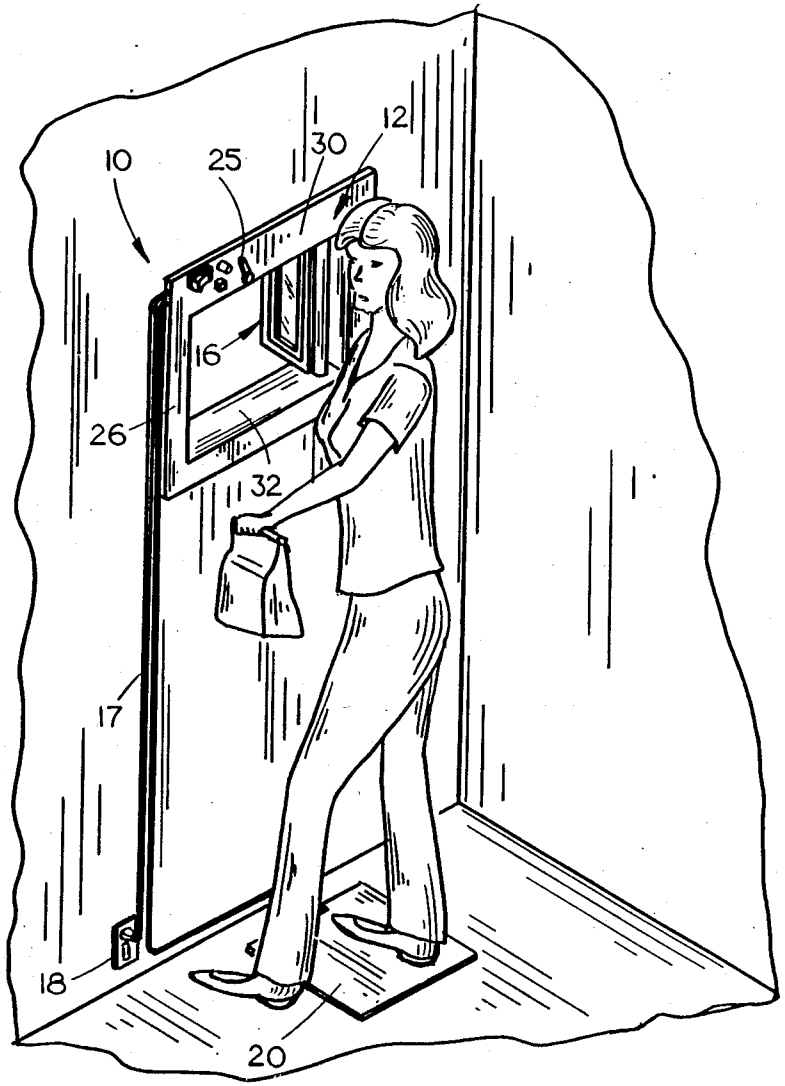
FIG. 2 is a perspective view of the automatic window with an operator standing on the floor mat, and with the window units opened.
Figure 1:
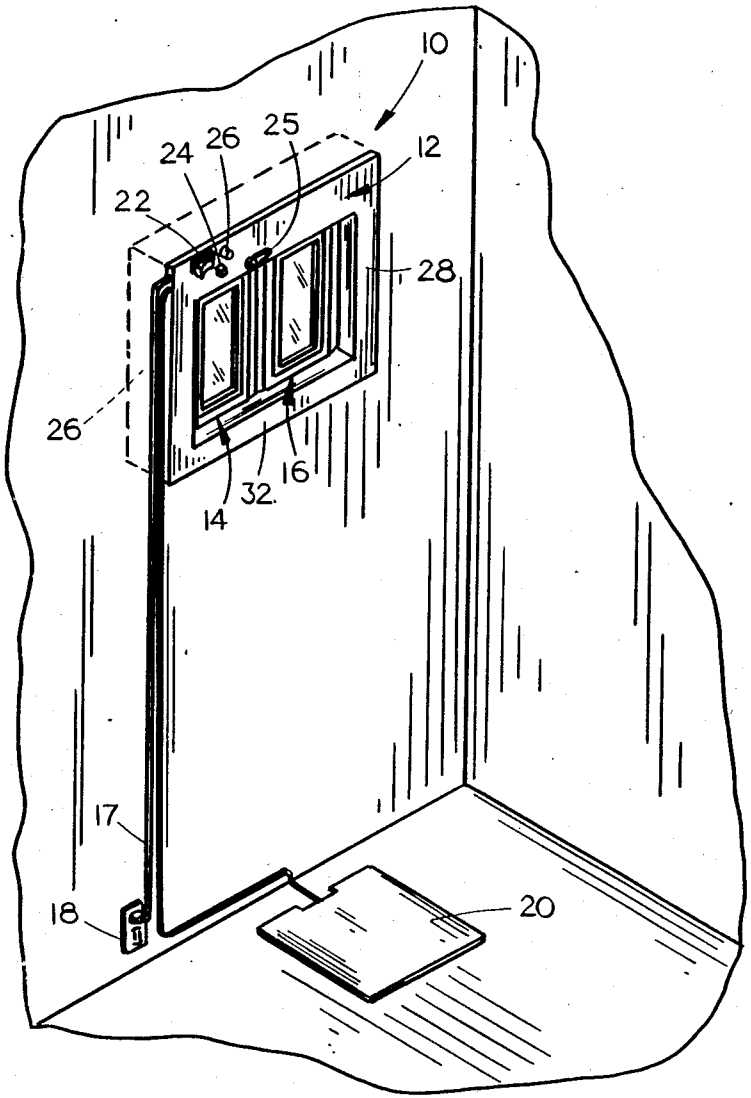
FIG. 1 is a perspective view of the automatic window of the invention installed in a wall opening.

In the automatic window 10 the present invention is shown in FIGS. 1 and 2 as including a peripheral frame 12 having a pair of window units 14 and 16 supported on the frame for pivotable movement between the closed position of FIG. 1, lying generally within an upright transverse plain through the frame, and the opened positions of FIG. 2, deposed generally perpendicular to that plain. The window units are automatically opened and closed by a motor or other power source enclosed within the frame. Electric cord 17 is provided for electrically connecting in the electric motor power source to a conventional wall outlet 18. Actuation of the power source is controlled by a hands free switch such as the floormat switch 20. Other controls illustrated on the interior side of the frame include an on/off switch 22, indicator lamp at 24, fuse 26 and lock lever 25.

Figure 4:
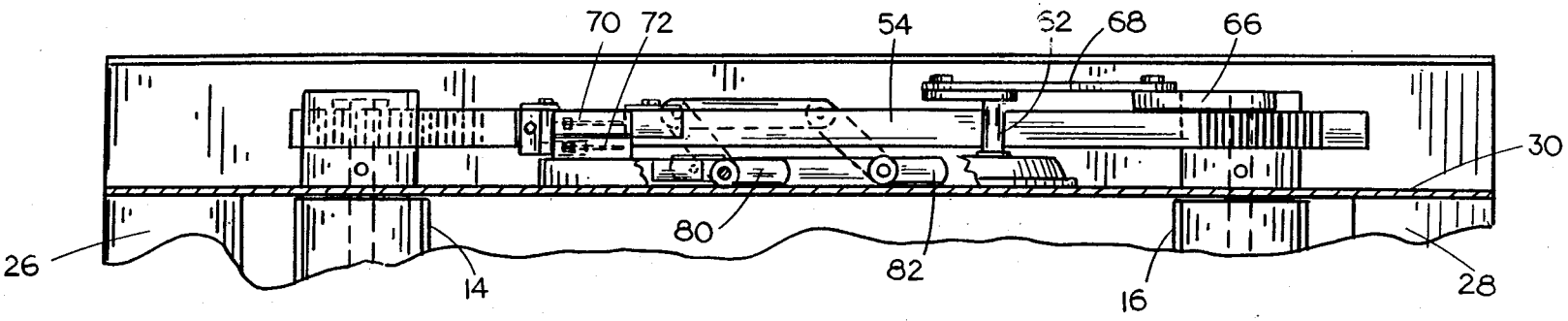
FIG. 4 is partial elevational view of the mechanical drive mechanism with the window units in the opened position.
Figure 3:
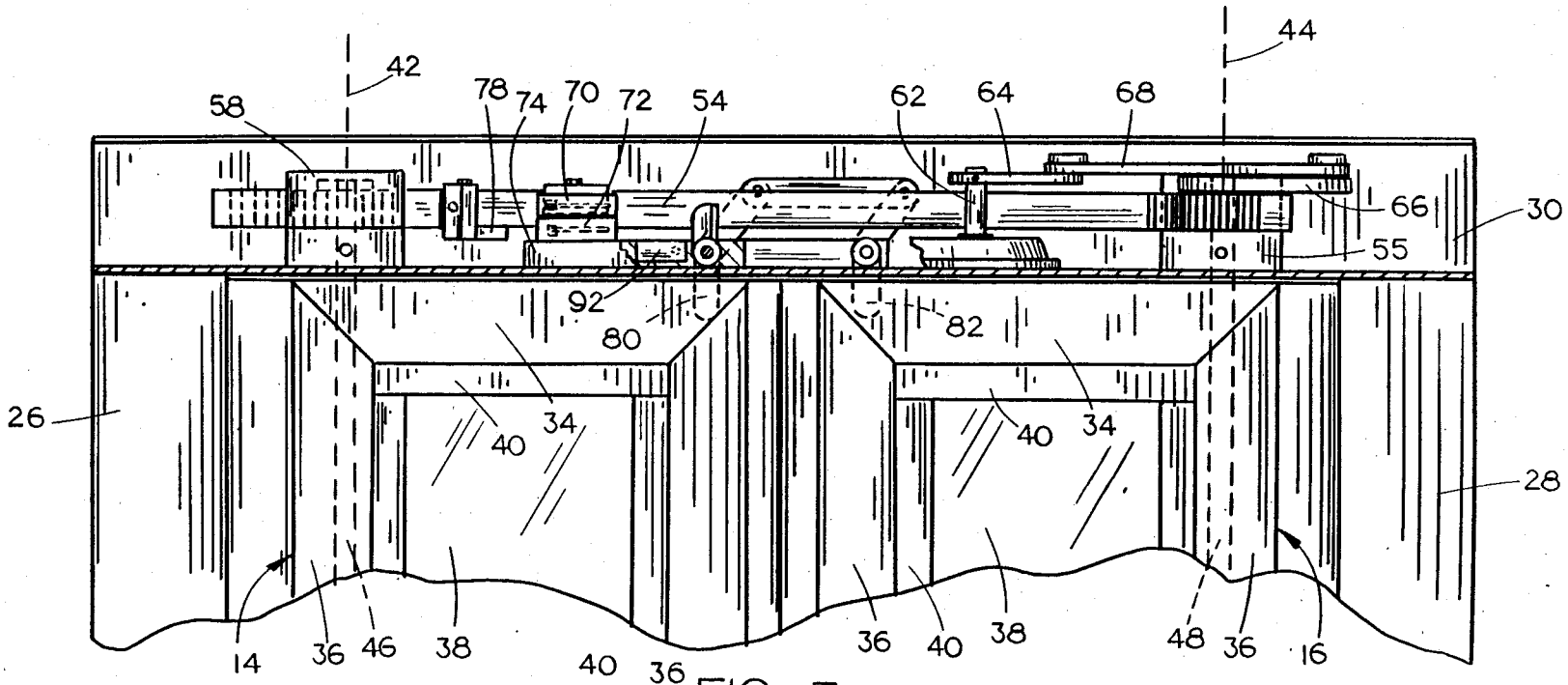
FIG. 3 is a partial elevational view of the mechanical drive mechanism with the window units in the closed positions.
Figure 5:
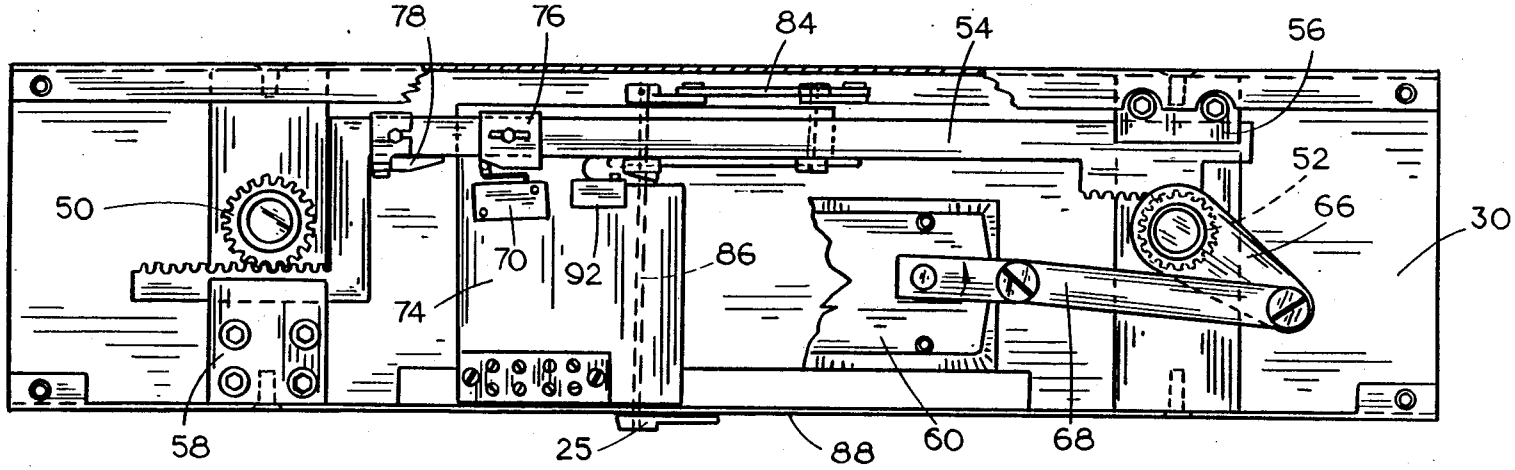
FIG. 5 is a top plan view of the automatic window with the cover removed and the window units in the closed positions.
Figure 6:
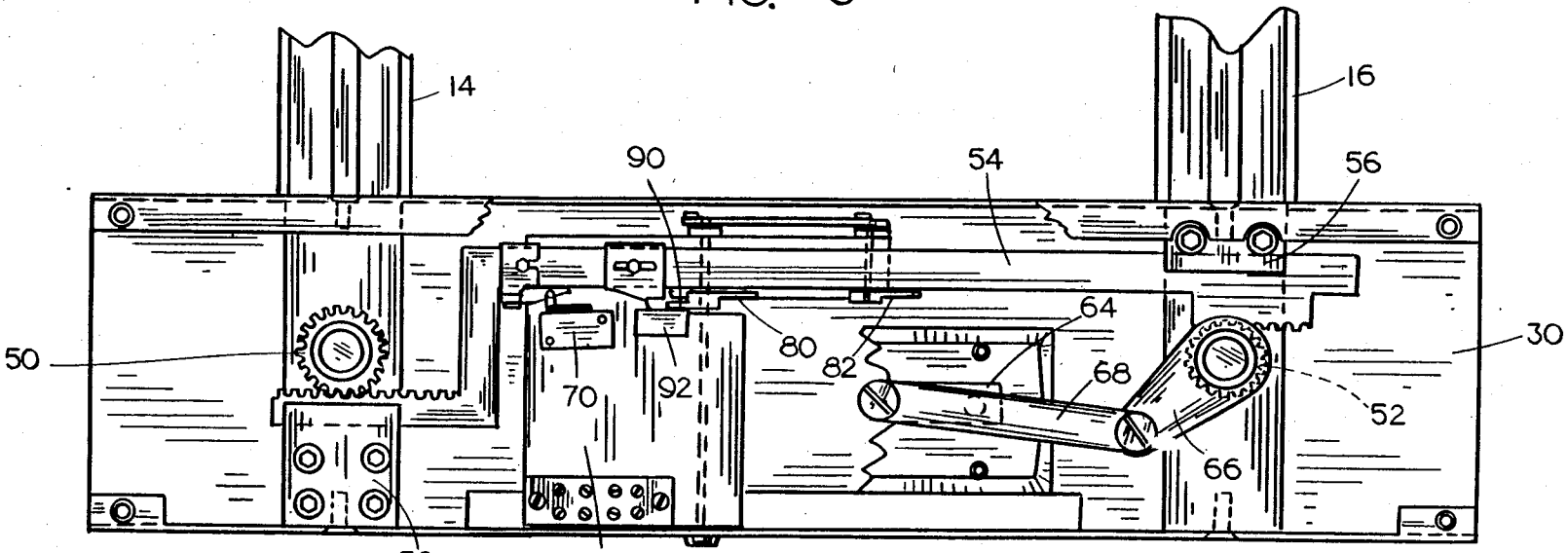
FIG. 6 is a top plan view of the automatic window with the cover removed and portions cut away for clarity, showing the window units in the opened positions.

The structure for opening and closing window units 14 and 16 is illustrated in FIGS. 3–6. The FIGS. 3 and 5 show the window units in the closed positions, whereas FIGS. 4 and 6 show the window units in the opened positions.

Preliminarily, FIG. 3 shows that frame 12 includes a pair of upright transversely spaced apart side walls 26 and 28 and a top wall 30 connected to and extended between the side walls. A bottom wall 32, is shown in FIG. 1, may be included as well where the window is not constructed on a shelf surface. The frame members are preferably formed of $1\frac{3}{4}\times4\frac{1}{2}$ inch conventional aluminum store front tubing have a dark anodized bronze finish which is compatable aesthetically with the existing construction of most retail establishments. Each window unit 14 is constructed with a mitered rail 34 and styles 36 with integral clips anchored by concealed screws for a strong, attractive structure. An insulated glass pane 38 of preferrably $\frac{5}{8}$ inch total thickness is supported within each window unit by a glazing beads 40.

The window units 14 and 16 are pivotally supported within frame 12 for pivotal movement about respective upright axes 41 and 44 by respective drill rods 46 and 48 which extend continuously through each window unit, as indicated in FIG. 3. The upper and lower ends of the drill rods are pivotally received within plastic bearings of a Delron or Walren material. In automatic windows without a bottom wall, the lower end of the drill rod would be received within bearings independently supported on the associated shelving surface.

As shown thus in FIG. 5, a pair of spur gears 50 and 52 are secured to the upper ends of the drill rods for rotation therewith. Each spur gear is in meshed relation with a gear surface of an elongated rack gear 54 which is constrained by the spur gears and plastic bushings 56 and 58 to back and forth transverse sliding movement. Since the rack gear 54 engages the outer surface of spur gear 52 and the inter surface of spur gear 50, the two window units are rotated in unison but in opposite directions in response to transverse movement of the rack gear.

The rack gear 54 is moved by an electric motor 60 having a unidirectional output shaft 62. The motor is connected to the gearing by a crank rocker mechanism including crank arm 64 on the motor output shaft 62, rocker arm 66 secured to spur gear 52 and connecting link 68.

Actuation of motor 60 is controlled by a pair of vertically stacked limit switches 70 and 72 supported on the bearing block 74 on frame top wall 30. At first cam 76 is a length adjustably secured to the rack gear 54 for engaging the top limit switch 70 to deactivate motor 60 in response to leftward movement of the rack gear for closing the window units. Upon the rightward movement of the rack gear 54, a second cam 78 engages the lower limit switch 72, as shown in FIGS. 4 and 6 to again deactivate the motor when the window units are moved to be opened position thereof.

Actuation of the motor 60 to open the window units is accomplished by the hands-free floormat switch 20. When the attendant steps on the mat, the motor is automatically actuated to rotate the output shaft and crank arm 64 counterclockwise from the position of FIG. 5 to the position of FIG. 6. The motor is again actuated to continue the counterclockwise rotation of the crank arm back to the position of FIG. 5 upon removal of the attendant's foot from the floormat 20.

Whereas the floormat switch 20 is shown as a preferred hands-free switch for the automatic window of the invention, it could be replaced by a hip switch which simply requires the attendant to lean against it, or by an electronic presence detector having a beam interrupted by the presence of an attendant adjacent the automatic window, for example.

Security for the automatic window 10 is provided by an independent lock system including a pair of pivotally supported lock tabs 80 and 82 which are pivotally movable between the locked positions of FIG. 3 wherein movement of the window units 14 and 16 from their closed positions is obstructed and the unlocked positions of FIG. 4 wherein movement of the window units 14 and 16 from their closed positions is unobstructed. The tabs are preferably received in recesses in the top surface of the window units in their closed positions for concealment and inaccessability of the tabs when the window units are closed and locked. The lock tabs 80 and 82 include integral upstanding pivot arms connected by link 84 for movement in unison. A lock shaft 86 extends inwardly from tab 80 through inner wall 88 of top wall 30 for connection to the lock lever 25.

For additional security and protection of motor 60, lock tab 80 has a cam extension 90, as shown in FIG. 6, which engages limit switch 92 when the lock tabs are in the unlocked positions but which becomes disengaged from the limit switch when the lock tabs are moved to the locked positions as shown in FIG. 5, thereby disabling motor 60 until the tabs are again moved to the unlocked positions. Thus even if the lock tabs are cut off or otherwise rendered inoperative by vandals, the connection of the deactivated motor to the window units affords backup security preventing opening of the window units.

Figure 7:
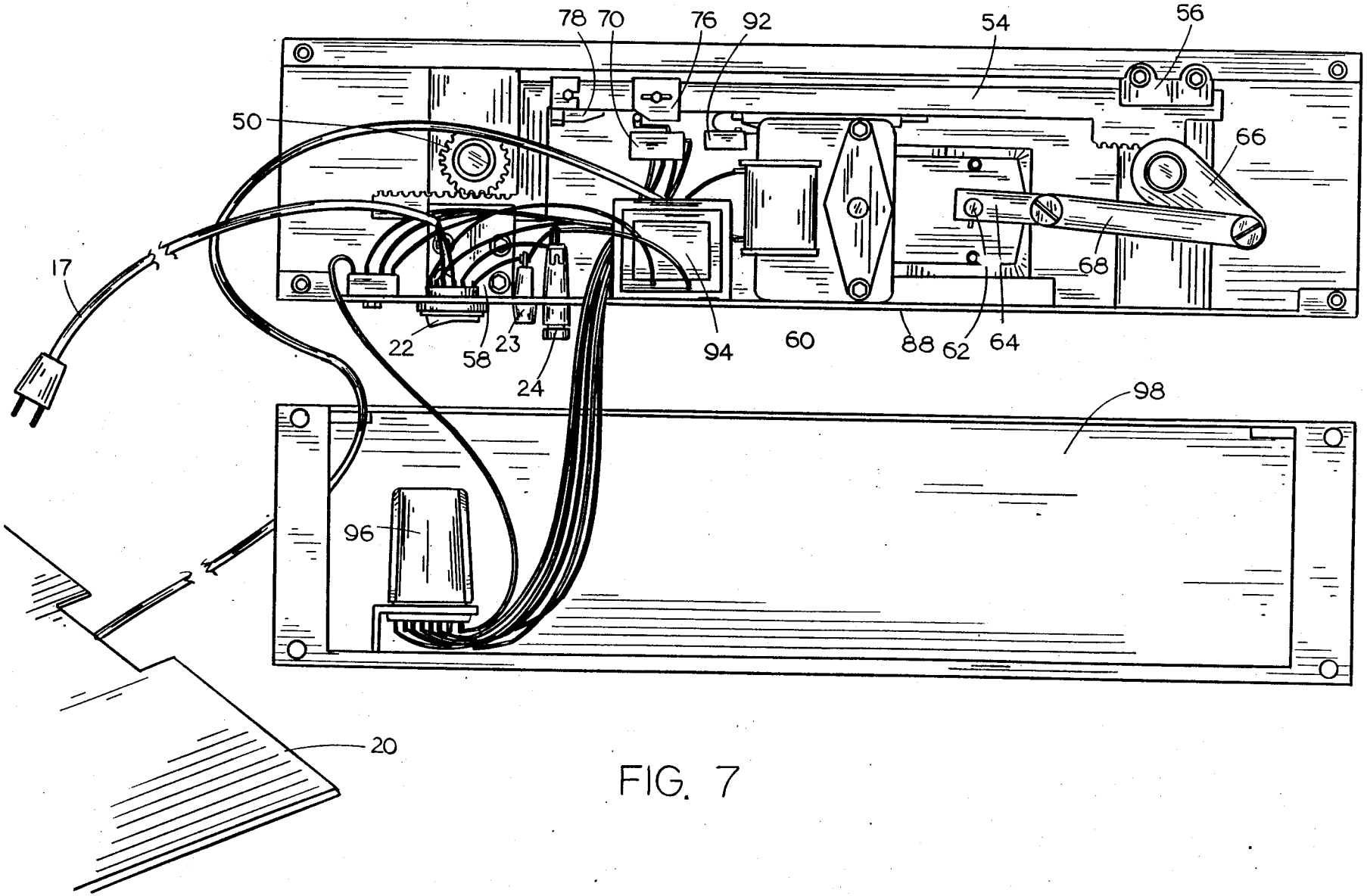
FIG. 7 is a top view of the automatic window with the cover removed showing the placement of various elements therein.

The various electrical components of the automatic window 10 are illustrated in FIG. 7. Cord 17 is connectible to a conventional wall outlet for a source of 110 volt electricity. Current from the cord 17 is directed through on off switch 22 to a full wave bridge rectifier 94 which provides 6 volts D.C. current to the floormat switch 20 to eliminate danger in case of water seepage and the like. A 6-volt double pole, double throw relay 96 is secured to the coverplate 98 for top wall 30 so that the hands free switch is operative to activate the electric motor 60 as described above.

Figure 8:
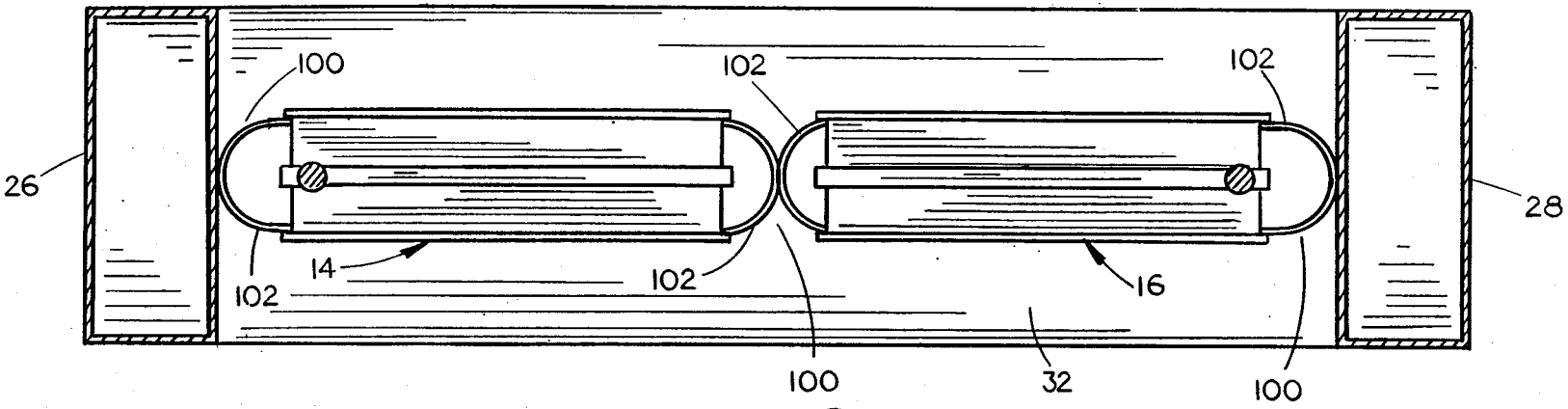
FIG. 8 is a top sectional view through the window units.
Figure 9:
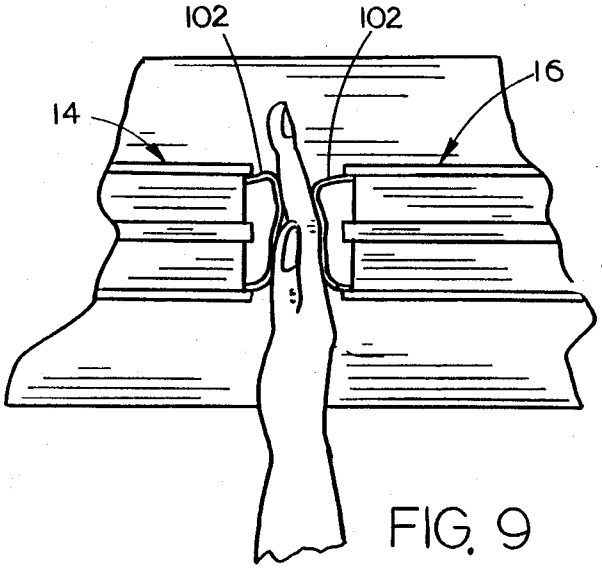

With reference to FIGS. 8 and 9, it is seen that the combined widths of the window units 14 and 16 is substantially less than the spacing between the frame side walls 26 and 28. Accordingly, when the window units 14 and 16 are in the closed positions of FIG. 8, clearance spaces 100 are provided between the window units 14 and 16 and between each window unit and the adjacent frame side wall. These clearance spaces are filled by resilient deformable finger guards 102 which are secured to the opposite side edges of each window unit. Each finger guard may be provided as a elongated resilient strip substantially spanning the vertical height of the associated window unit. The finger guards 102 may be made of $\frac{1}{8}$th inch neoprene which is resilient in cold weather, for an effective year around weather seal. In the event that the hand of either an attendant or a customer is situated within one of the clearance spaces 100 upon automatic closing of the window units 14 and 16, the finger guards deflect sufficiently that no injury is caused. The width of the outer clearance spaces adjacent the frame side walls is preferably between 2 and 4 centimeters and a similar width is preferred for the center clearance space between the window units.

Whereas the automatic window of the invention has been shown and described in connection with a preferred embodiment thereof, it is understood that many modifications, substitutions and additions may be made which are within the intended broad scope of the appended claims. For example, the top inside panel surface of which the on/off switch, fuse and indicator lamp are mounted, might be hinged to allow access to the mechanism for manual operation in the event of a power failure, for example. Screws with thumb-turn heads could be provided for the crank rocker mechanism link 68 so that it could be removed to disconnect the window units from the deactivated motor. A microswitch would preferably be provided on the pivoted access door to cut power to the unit when the door is opened.

Thus there has been shown and described an automatic window which accomplishes at least all of the stated objects.

I claim:

1. An automatic window, comprising a frame including a pair of upright transversely spaced-apart side walls and a top wall connected to and extended between said side walls, a pair of window units, means for supporting said window units on said frame for pivotal movement about respective upright axes between closed positions lying generally within an upright transverse plane through said frame and open positions disposed generally perpendicular to said plane, the combined widths of said window units being substantially less than the spacing between said frame side walls whereby, in the closed positions of said window units, clearance spaces are provided between said window units and between each window unit and the adjacent frame side wall, resilient deformable finger guards on opposite side edges of said window units, said finger guards substantially filling said clearance spaces upon movement of the window units to the closed positions, mechanical drive means interconnecting said window units for rotation in unison in opposite directions between the open and closed positions thereof, power means operatively connected to said drive means and actuatable to move said window units between the open and closed positions thereof, hands free switch means electrically connected to said power means for actuating said power means, coacting lock means on said frame and window units, said lock means including a lock tab movable between a locked position wherein movement of the window units from the closed positions is obstructed and an unlocked position wherein movement of the window units from the closed positions is unobstructed, and switch means associated with said lock means for deactivating said power means in response to movement of said lock means to the locked position thereof.

2. The automatic window of claim 1 wherein said frame further comprises a bottom wall connected to and extended between said side walls.

3. The automatic window of claim 1 further comprising electrical circuit means interconnecting said switch means, power means and hands free switch means for actuating said power means to move the window units to the open positions in response to closing of said hands free switch means and to move the window units to the closed positions in response to opening of said hands free switch means.

4. The automatic window of claim 3 wherein said hands free switch means comprises a floor mat switch.

5. The automatic window of claim 3 wherein said electrical circuit means comprises first and second limit switches and cam means on said mechanical drive means for actuating said limit switches in response to movement of the window units to the open and closed positions, respectively.

6. The automatic window of claim 1 wherein the transverse width of each clearance space is between two and four centimeters.

7. The automatic window of claim 6 wherein said finger guards each comprise an elongated resilient strip substantially spanning the vertical height of the associated window unit.

8. The automatic window of claim 1 wherein the means for supporting said window units comprises a pivot shaft secured to each window unit and extended upwardly therefrom and bearing means on said frame for pivotally receiving the pivot shafts.

9. The automatic window of claim 8 wherein said mechanical drive means includes a pinion gear on each pivot shaft and a rack gear extended between said pinion gears in meshed relation therewith.

10. The automatic window of claim 9 wherein said power means comprises an electric motor having an upright output shaft and a crank rocker mechanism connecting said motor output shaft to one window unit pivot shaft for oscillating said pivot shaft in response to rotation of the output shaft.

11. An automatic window, comprising, a frame including a pair of upright transversely spaced-apart side walls and a top wall connected to and extended between said side walls, at least one window unit, means for supporting said window unit on said frame for pivotal movement about an upright axis between a closed position lying generally within an upright transverse plane through said frame and an open position disposed generally perpendicular to said plane, the width of said window unit being substantially less than the spacing between said frame side walls whereby, in the closed position of said window unit, clearance spaces are provided between said window unit and the adjacent frame side walls, resilient deformable finger guards on opposite side edges of the window unit, said finger guards substantially filling the clearance spaces upon movement of the window unit to the closed position, power drive means operatively connected to the window unit and actuatable to move the window unit between the open and closed positions thereof, hands free switch means electrically connected to said power drive means for actuating said power drive means, coacting lock means on said frame and window units, said lock means including a lock tab movable between a locked position wherein movement of the window unit from the closed position is obstructed and an unlocked position wherein movement of the window unit from the closed position is unobstructed, and switch means associated with said lock means for deactivating said power drive means in response to movement of said lock means to the locked position thereof.

* * * * *